US009724546B2

(12) United States Patent
Huggins et al.

(10) Patent No.: US 9,724,546 B2
(45) Date of Patent: Aug. 8, 2017

(54) RESPIRATORY PROTECTION EQUIPMENT

(75) Inventors: Adrian Huggins, Worthing (GB); Bernard Robert Money, Aldershot (GB); Rajinder Singh, Sandhurst (GB); David Thomas Steele, Hook (GB)

(73) Assignee: QINETIQ LIMITED, Hampshire (GB)

( * ) Notice: Subject to any disclaimer, the term of this patent is extended or adjusted under 35 U.S.C. 154(b) by 269 days.

(21) Appl. No.: 13/819,454

(22) PCT Filed: Jun. 24, 2011

(86) PCT No.: PCT/GB2011/000942

§ 371 (c)(1),
(2), (4) Date: Feb. 27, 2013

(87) PCT Pub. No.: WO2012/028836

PCT Pub. Date: Mar. 8, 2012

(65) Prior Publication Data

US 2013/0180523 A1 Jul. 18, 2013

(30) Foreign Application Priority Data

Sep. 3, 2010 (GB) ..... 1014618.1

(51) Int. Cl.
*A62B 27/00* (2006.01)
*A41D 13/11* (2006.01)
(Continued)

(52) U.S. Cl.
CPC ..... *A62B 27/00* (2013.01); *A41D 13/11* (2013.01); *A62B 7/02* (2013.01); *A62B 9/006* (2013.01); *A62B 17/04* (2013.01); *A62B 18/08* (2013.01)

(58) Field of Classification Search
CPC ..... A62B 27/00
USPC ..... 128/201.22–201.24, 202.22, 205.25, 128/206.12, 206.14, 206.21, 206.24; 600/382, 393, 395
See application file for complete search history.

(56) References Cited

U.S. PATENT DOCUMENTS 4,393,584 A * 7/1983 Bare et al. ..... 29/877
4,951,664 A * 8/1990 Niemeyer ..... A62B 18/025 128/205.27

(Continued)

FOREIGN PATENT DOCUMENTS

DE 102004058781 A1 6/2006
EP 0661071 A1 7/1995

(Continued)

OTHER PUBLICATIONS

Wikipedia, "Elastomer", retrieved from https://web.archive.org/web/20100410002300/http://en.wikipedia.org/wiki/Elastomer with date Apr. 10, 2010.*

(Continued)

*Primary Examiner* — (Jackie) Tan-Uyen T Ho
*Assistant Examiner* — Joseph D Boecker
(74) *Attorney, Agent, or Firm* — Oliff PLC

(57) ABSTRACT

A respirator has one or more electrodes of e.g. conductive elastomer disposed on the surface of a face sealing member opposite to the surface which seals against the user's face. In use the integrity of the seal formed between the sealing member and the user's face is monitored by monitoring the electrical capacitance across that member between the electrode(s) and the user's face.

14 Claims, 5 Drawing Sheets

(51) Int. Cl.

| | |
|---|---|
| ***A62B 17/04*** | (2006.01) |
| ***A62B 7/02*** | (2006.01) |
| ***A62B 9/00*** | (2006.01) |
| ***A62B 18/08*** | (2006.01) |

(56) References Cited

U.S. PATENT DOCUMENTS

| | | | | |
|---|---|---|---|---|
| 5,148,805 | A * | 9/1992 | Scharnberg | 607/2 |
| 5,617,849 | A * | 4/1997 | Springett | A62B 27/00 128/201.23 |
| 6,032,065 | A * | 2/2000 | Brown | 600/383 |
| 6,240,921 | B1 * | 6/2001 | Brydon et al. | 128/205.23 |
| 7,187,985 | B2 * | 3/2007 | Carim | 607/152 |
| 7,204,250 | B1 * | 4/2007 | Burton | 128/205.23 |
| 2004/0163648 | A1 * | 8/2004 | Burton | A61B 5/04085 128/204.21 |
| 2006/0074284 | A1 * | 4/2006 | Juola | A61B 5/0408 600/372 |
| 2007/0078316 | A1 * | 4/2007 | Hoarau | A61B 5/14552 600/323 |
| 2010/0030167 | A1 * | 2/2010 | Thirstrup | A61F 5/445 604/318 |
| 2010/0147304 | A1 | 6/2010 | Burton | |
| 2011/0306892 | A1 * | 12/2011 | Kim | A61B 5/0408 600/509 |
| 2015/0209540 | A1 * | 7/2015 | Hendriks | A61M 16/0683 128/204.21 |
| 2016/0184538 | A1 * | 6/2016 | Grashow | A61M 16/0051 128/202.22 |
| 2017/0065784 | A1 * | 3/2017 | Mashal | A61M 16/0683 |

FOREIGN PATENT DOCUMENTS

| | | | |
|---|---|---|---|
| GB | 2130893 | A | 6/1984 |
| JP | A-7-155389 | | 6/1995 |
| WO | WO 97/10027 | | 3/1997 |
| WO | WO 03/095031 | A1 | 11/2003 |
| WO | WO 2012/010815 | A1 | 1/2012 |

OTHER PUBLICATIONS

Nov. 9, 2010 Search Report issued in British Application No. 1014618.1.

Oct. 6, 2011 International Search Report issued in International Patent Application No. PCT/GB2011/000942.

Oct. 6, 2011 Written Opinion issued in International Patent Application No. PCT/GB2011/000942.

* cited by examiner

RESPIRATORY PROTECTION EQUIPMENT

The present invention relates to respiratory protection equipment (RPE), which expression encompasses military and industrial respirators (both unpowered and powered types), gas masks, dust masks, surgical masks, compressed air and oxygen-fed breathing apparatus, and the like.

RPE typically incorporates a sealing member adapted to form a seal against the face of the user (whether around the whole periphery of the face or at least around the nose and mouth) to isolate his respiratory organs from the external environment and, where appropriate, conserve the breathing gas supply. The integrity of the seal thus formed is crucial to the protection afforded by the equipment and it is important that the sealing member is correctly fitted to the face when the equipment is donned and remains so throughout the period of use. It can be compromised by such factors as incorrect alignment with the face, variations in face shape between different users, incorrect strap tension, debris between the face and sealing member, and exacerbated by exertion of the user. The seal integrity is typically checked by performing a pressure test when donning but it would be useful for some means to be provided for monitoring the integrity of the seal thereafter so that if a gap is discovered the user can take corrective action, e.g. by adjusting the harness or other means by which the sealing member is held to his face, or even abandoning a mission if there is a risk of substantial leakage.

With the foregoing in mind, in one aspect the present invention resides in respiratory protection equipment comprising a sealing member adapted to form a seal against the face of the user, one or more electrodes disposed upon or within the sealing member, and means for monitoring the integrity of said seal by monitoring the electrical capacitance across the sealing member between said electrode(s) and the face of the user.

The invention likewise resides in a method of monitoring the integrity of a seal formed by a sealing member of respiratory protection equipment against the face of the user, which comprises monitoring the electrical capacitance across the sealing member between one or more electrode(s) disposed upon or within the sealing member and the face of the user.

It will be appreciated that the monitoring of capacitance "across the sealing member" will involve only part of the thickness of that member when the electrode(s) are disposed within that member.

The electrode(s) of such RPE are preferably formed from an electrically-conductive elastomer, which may be filled with nickel-coated carbon.

There may be an array of the electrodes embedded in a moulded matrix material which is bonded to the sealing member.

The electrode(s) may alternatively be formed by printing onto a substrate with an electrically-conductive ink, and the substrate may be the sealing member itself.

The invention will now be more particularly described, by way of example, with reference to the accompanying drawings, in which.

Figure 1:
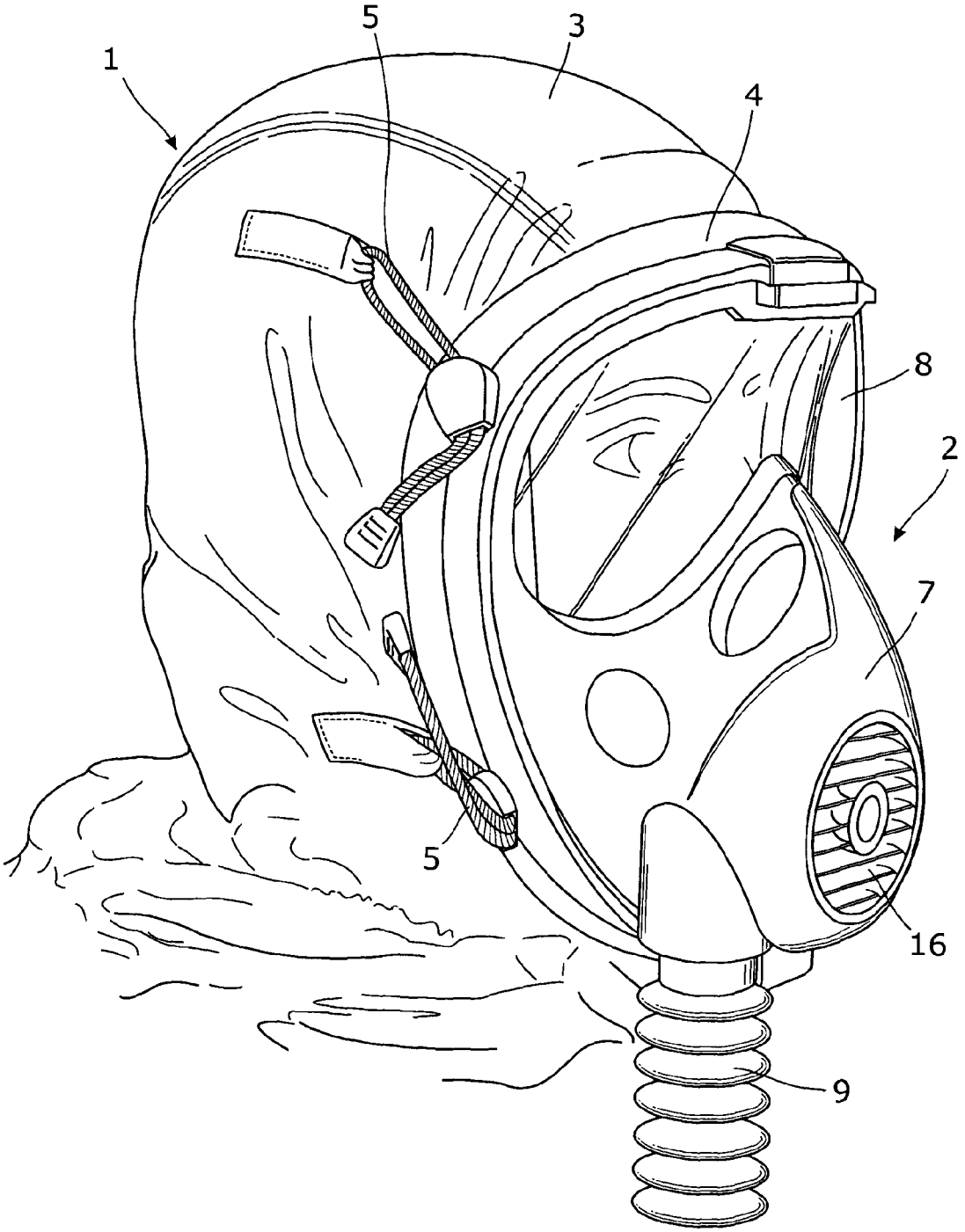
FIG. 1 is a pictorial view of one form of respiratory protection equipment to which the invention can be applied, as worn by a user.
Figure 2:
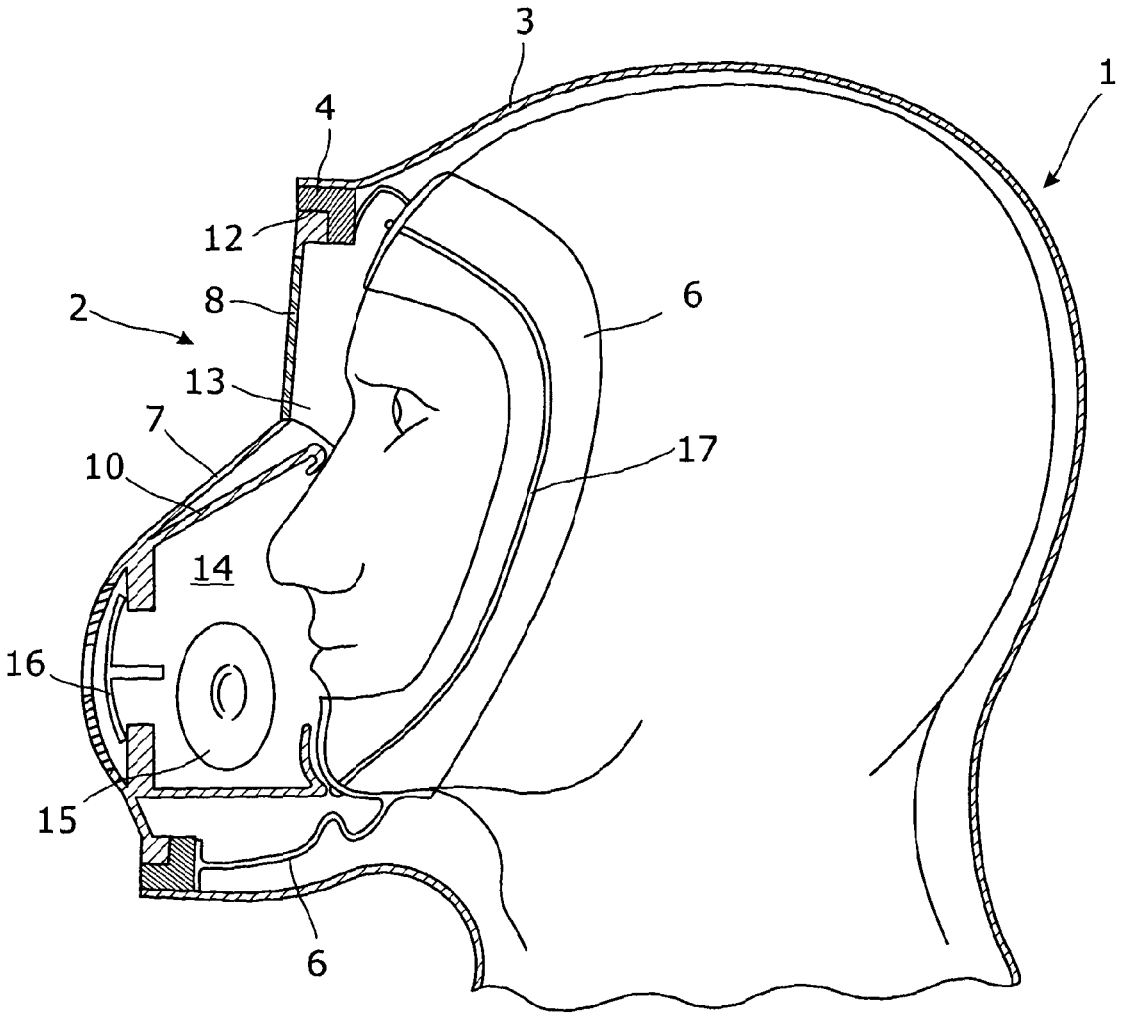
FIG. 2 is a schematic cross-sectional view of the RPE of FIG. 1.
Figure 3:
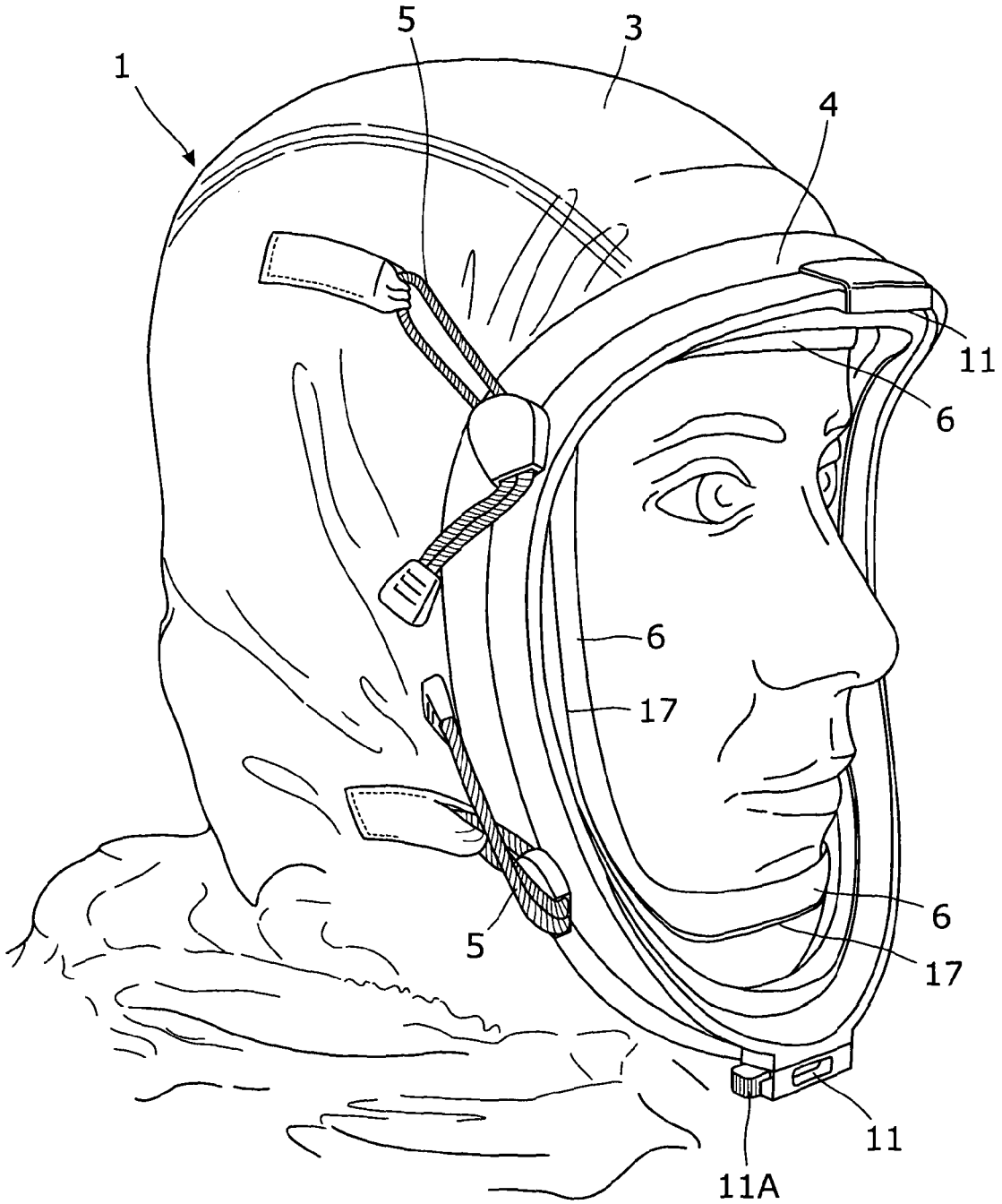
FIG. 3 is a pictorial view of the RPE of FIGS. 1 and 2 with the face piece sub-assembly removed.

Referring to FIGS. 1 to 3 these show one form of RPE to which the invention can be applied, being a respirator hood for service personnel to provide protection against nuclear, biological or chemical (NBC) hazards. It is of a form described in WO03/095031 comprising a hood sub-assembly 1 and a demountable face piece sub-assembly 2 so that the respirator can be worn in the fully assembled condition of FIGS. 1 and 2 or with the face piece sub-assembly removed as shown in FIG. 3, the latter to permit free breathing of ambient air e.g. when standing by for action or when there may be a threat of a hazard but no actual hazard encountered.

The hood sub-assembly 1 comprises a flexible head covering 3 which is also extended downwards over the shoulders of the user, and a substantially rigid profiled ring 4 attached to the head covering so as to encircle the face of the user at an appropriate spacing when the head covering is donned. The ring 4 and covering 3 are secured together around the whole of their mating edges and additional adjustable ties 5 are provided between these elements to assist in supporting the ring 4 and the face piece sub-assembly 2 when the latter is added. The ring 4 also carries a sealing member in the form of a profiled elastomeric gasket 6, typically of butyl rubber or other suitable elastomer, which is adapted to extend into sealing engagement around the periphery of the user's face when the head covering is donned.

The face piece sub-assembly 2 comprises a moulded face plate 7 with inset lens 8 and a fitted air supply hose 9. Internally it carries an oronasal mask 10 (FIG. 2) with a soft sealing edge to engage around the mouth and nose of the user when donned. The face piece sub-assembly 2 can be demountably attached to the hood sub-assembly 1 and in the illustrated embodiment is retained by lugs (not shown) on the face plate 7 engaging in sockets 11 (FIG. 3) formed on the ring 4, one of which includes a manually-releasable latch 11A. The periphery of the face plate 7 is profiled to match the contour of the ring 4 and carries a seal 12 (FIG. 2) to ensure a gas-tight connection between those elements when attached.

In the fully assembled condition of the respirator shown in FIG. 2 a facial cavity 13 is formed, bounded by the face plate 7 and gasket 6, in which the user's nose, mouth and eyes are isolated from the external environment. The integrity of the peripheral face seal formed by the gasket 6 is crucial in this respect. Within the facial cavity 13 a smaller subdivision 14 is formed by the interior of the oronasal mask, but the integrity of the latter is of secondary importance to the gasket 6.

In use of the respirator clean filtered air is supplied via the hose 9 (FIG. 1) and enters the oronasal mask cavity 14 through a one-way inlet valve 15 (FIG. 2). Exhaled air is vented to atmosphere through a one-way outlet valve 16. A stream of air is also directed through ports (not shown) in the mask 10 to pass over the interior face of the lens 8 for demisting purposes, in accordance with known practice. Although not illustrated as such, the valves 14 and 15 may be of the form described in our copending United Kingdom patent application no. 1012205.9.

In accordance with the present invention the gasket 6 bears an electrode 17 which in the illustrated embodiment (FIGS. 2 and 3) comprises a length of electrically-conductive elastomer extending around the gasket on its surface opposite to that which seals against the user's face. The electrode typically comprises a strip of silicone rubber with a nickel-coated carbon fibre filler, that is bonded or co-moulded to the gasket. Alternatively the electrode may be embedded within the thickness of the gasket. A conductive elastomer is preferred for this purpose because it is flexible and stretchable and its presence on the gasket will not significantly stiffen the latter or impair its ability to conform to the contours of the user's face.

Figure 4:
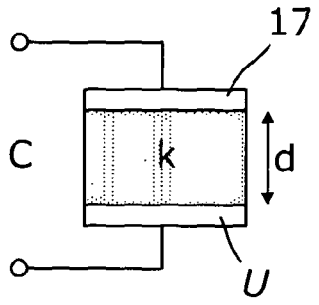
FIG. 4 illustrates a capacitance model useful for understanding the invention.

The electrode 17 is effectively used as part of a sensor system for monitoring the integrity of the seal formed between the gasket 6 and the user's face by monitoring the electrical capacitance across the gasket between the electrode and face. In this respect the arrangement can be visualised as a classic capacitor comprising a pair of plates separated by a dielectric as depicted in FIG. 4, where the plates are represented by the electrode 17 and the corresponding portion of the user's face U respectively and (in the case where the gasket is fully sealed against the face) the dielectric is represented by the thickness of the gasket (plus any layer of adhesive between the electrode and gasket). It is well known that in such an arrangement capacitance is given by:

$$C = \frac{k\varepsilon_0 A}{d}$$

where:

C is capacitance in Farads (F)

A is the area of the plates in square metres ($m^2$)

d is the distance between the plates in metres (m)

k is the dielectric constant of the material separating the plates $\epsilon_0$ is the permittivity of free space ($8.85\times10^{-12}$ F/m)

It follows from this model that if at any location along the length of the electrode 17 the gasket 6 is not properly sealed against the face, i.e. a gap exists between the gasket and face, then at that location d will be greater than for the fully sealed condition and the aggregate k will be lower than for the fully sealed condition due to the existence of air between the gasket and face, so due to both of these factors the total capacitance will be reduced in comparison to the fully sealed condition.

In practice therefore if a baseline capacitance measurement is taken after donning the respirator and checking that the gasket 6 is fully sealed against the face—e.g. with a pressure test and/or by employing an experienced respirator fitter—subsequent monitoring of the capacitance can be used to monitor the integrity of the seal and a signal can be given to the user, so that he can take corrective action, in the event that the capacitance falls to a level which indicates the presence of a gap somewhere around the gasket.

Figure 5:
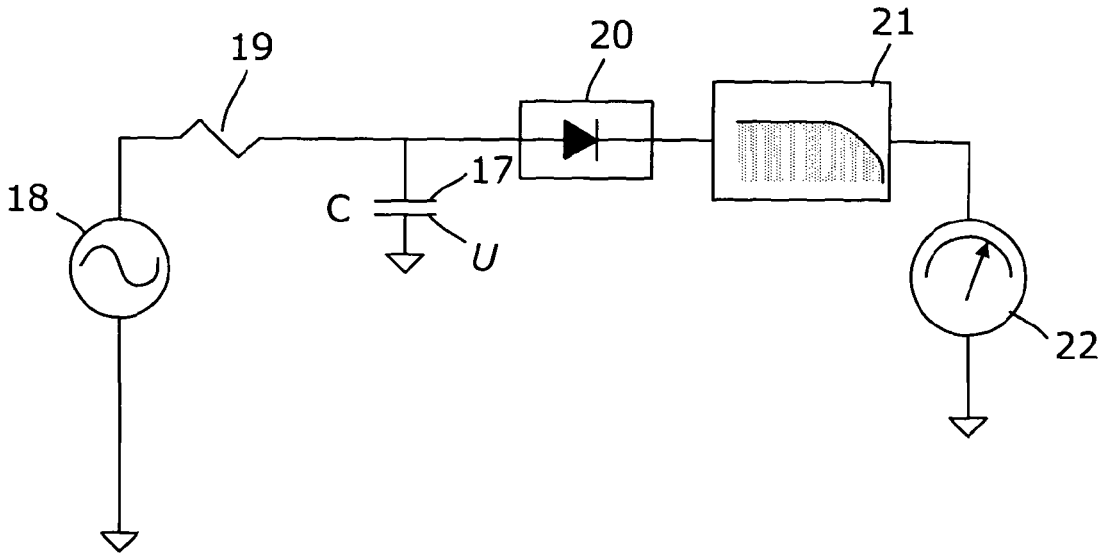
FIG. 5 illustrates a circuit for measuring the capacitance.

A circuit which can be used for measuring this capacitance is indicated schematically in FIG. 5. A low voltage (typically 5V peak-to-peak) AC waveform is produced by a generator 18 and applied to the electrode 17 of the above-described capacitive arrangement which is indicated at C in FIG. 5, the user's face U acting as a virtual ground. A load resistor 19 is used to set the frequency to a low RF value, typically 120 khz. The capacitor acts as a voltage divider and the AC signal is rectified and converted to a DC level by a detector 20, this level accordingly being proportional to 1/C. A low pass filter 21 is used to reduce noise in the DC level which is read as notionally indicated at 22.

It will be appreciated that while a single electrode such as 17 can be used to identify if there is a gap in the seal between the gasket 6 and the user's face at any location along its length it cannot indicate at which actual position around the gasket the gap exists. For this reason there may instead be a plurality of shorter electrodes disposed around the circumference of the gasket and indeed a plurality of rows of such electrodes across the width of the gasket, all addressed in turn by use of a suitable micro controller so that it is possible to identify the location of any gap both circumferentially and widthwise of the gasket. The distribution of such electrodes may also be varied at different regions of the gasket so that the resolution of the arrangement is greater in regions of greater leakage potential (e.g. temples and jaw) than in regions where a reliable seal is more easy to maintain (e.g. across the brow).

Figure 6:
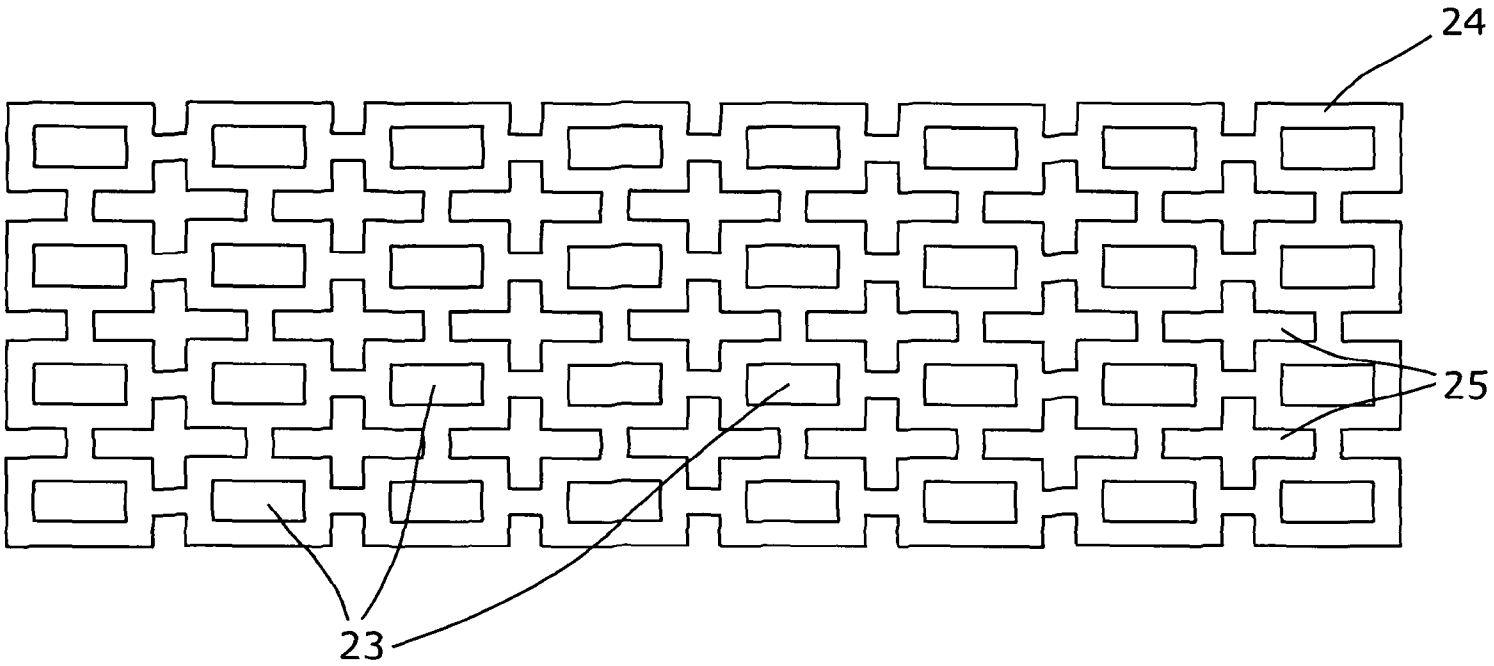
FIG. 6 illustrates a multiple electrode structure which may be employed with the invention.

When a multiplicity of electrodes are required, structures such as the one illustrated in FIG. 6 may be employed. This comprises an array of patch electrodes in the form of pieces of conductive elastomer 23 embedded in a moulded matrix of polyurethane 24 which can be bonded to the surface of the gasket 6 opposite to that which seals against the user's face, particularly in regions where high resolution for the location of possible gaps is required. The matrix has a lattice structure with numerous apertures 25 for maximum flexibility, and individual matrices can be moulded to follow the contour of the respective regions of the gasket to which they are to be bonded. They can be overlaid with a flexible PCB to connect the individual electrodes 23 to the requisite driver/reader/micro controller. The elastomer electrodes are typically 6 mm×4 mm in area and 2 mm thick and it has been found that with this small size the sensitivity of the system is sufficient to identify the presence of a single human hair across the seal, which is typically the smallest and most common contaminant that leads to a respirator seal leak. Instead of the illustrated arrangement where the electrodes 23 are "line abreast" in each of the four rows a staggered or "brickwork" pattern can be employed so that at least one electrode will be encountered across the width of the gasket at any circumferential location. Individual conductive elastomer patch electrodes of this type could alternatively be moulded directly onto or into the gasket.

In an alternative embodiment the electrode(s), and tracks to connect them with a suitable driver/reader/controller, can be formed by printing with an electrically-conductive ink, either directly onto the surface of the gasket opposite to that which seals against the user's face or onto a thin flexible substrate of e.g. Mylar® which is bonded onto the gasket.

The type of signal that is conveyed to the user by the system for monitoring the integrity of the seal may be of any suitable visual, audible or tactile form. For example in the simple case where there is a single, universal electrode 17 such as illustrated in FIGS. 2 and 3 there may be a green light signal when the measured capacitance remains at or close to its "baseline" level and a red light signal when the capacitance falls below a certain threshold, or a succession of different light signals corresponding to a succession of diminishing capacitance thresholds. Where there are a plurality of electrodes disposed around the gasket a visual display could take the form of a dot pattern in the shape of the gasket where the respective dots are illuminated or change colour at certain capacitance thresholds to represent the status of the seal at respective locations, or a set of bar graphs of variable magnitudes could be used. The above visual displays could for example appear in the user's field of view through the lens 8 using known helmet-mounted display technology, or could appear on a wrist-mounted or other suitably located unit.

Although the invention has been described above with reference to a respirator featuring a demountable face piece assembly it will be appreciated that it is equally applicable to more conventional respirators with a fixed face piece and to all other forms of RPE where it is required to monitor the integrity of a seal formed between a sealing member and the user's face.

Furthermore although described above in terms of an aid to the user of a respirator throughout the period of use the invention may also or alternatively be used to aid the initial fitting of the equipment, for example employing a plug-in unit to indicate variations in the measured capacitance as the fit of the equipment is adjusted, and/or as an aid to training in the fitment of such equipment.

The invention claimed is:

1. Respiratory protection equipment comprising:

a sealing member adapted to form a seal against the face of a user, a plurality of electrodes disposed upon or within the sealing member, and a capacitance measuring circuit for monitoring the integrity of said seal by monitoring an electrical capacitance across the sealing member between said electrodes and the face of the user, wherein said electrodes are formed from an electrically conductive elastomer, and wherein said electrodes are distributed at positions so that a resolution of a signal of the capacitance measuring circuit is greater in regions of the sealing member having a higher leakage potential.

2. Equipment according to claim 1 wherein said elastomer is filled with nickel coated carbon.

3. Equipment according to claim 1 wherein there is an array of said electrodes embedded in a moulded matrix material which is bonded to the sealing member.

4. Equipment according to claim 1 wherein said electrode (s) are formed by printing onto a substrate with an electrically conductive ink.

5. Equipment according to claim 4 wherein said substrate is the sealing member.

6. Equipment according to claim 1, wherein the electrodes comprise an array of patch electrodes in the form of conductive elastomer embedded in a moulded matrix with the patch electrodes arranged in rows and columns.

7. Equipment according to claim 6, wherein the moulded matrix has a lattice structure with a plurality of dispersed apertures.

8. A method of monitoring the integrity of a seal formed by a sealing member of respiratory protection equipment against the face of a user, which comprises monitoring an electrical capacitance across the sealing member between a plurality of electrodes disposed upon or within the sealing member and the face of the user with a capacitance measuring circuit, wherein said electrodes are formed from an electrically conductive elastomer, and wherein said electrodes are distributed at positions so that a resolution of a signal of the capacitance measuring circuit is greater in regions of the sealing member having a higher leakage potential.

9. The method according to claim 8, wherein said elastomer is filled with nickel coated carbon.

10. The method according to claim 8, wherein the equipment comprises said sealing member adapted to form a seal against the face of the user, the plurality of electrodes disposed upon or within the sealing member, and the capacitance measuring circuit for monitoring the integrity of said seal by monitoring the electrical capacitance across the sealing member between said electrodes and the face of the user, and there is an array of said electrodes embedded in a moulded matrix material which is bonded to the sealing member.

11. The method according to claim 8, wherein the equipment comprises said sealing member adapted to form a seal against the face of the user, the plurality of electrodes disposed upon or within the sealing member, and the capacitance measuring circuit for monitoring the integrity of said seal by monitoring the electrical capacitance across the sealing member between said electrodes and the face of the user, and said electrodes are formed by printing onto a substrate with an electrically conductive ink.

12. The method according to claim 11, wherein said substrate is the sealing member.

13. The method according to claim 8, wherein the electrode comprise an array of patch electrodes in the form of conductive elastomer embedded in a moulded matrix with the patch electrodes arranged in rows and columns.

14. The method according to claim 13, wherein the moulded matrix has a lattice structure with a plurality of dispersed apertures.

* * * * *